US005884532A

United States Patent [19]

Rixon et al.

[11] Patent Number: 5,884,532

[45] Date of Patent: Mar. 23, 1999

[54] ADJUSTABLE PEDAL APPARATUS

[75] Inventors: Christopher J. Rixon, Tecumseh, Canada; Christopher Bortolon, Clawson, Mich.

[73] Assignee: Tecnology Holding Company II, Wilmington, Del.

[21] Appl. No.: 847,617

[22] Filed: Apr. 28, 1997

[51] Int. Cl.[6] ..... G05G 1/14

[52] U.S. Cl. ..... 74/512; 74/562

[58] Field of Search ..... 74/513, 512, 560, 74/562, 562.5, 514

[56] References Cited

U.S. PATENT DOCUMENTS

| | | | |
|---|---|---|---|
| 1,425,413 | 8/1922 | Page | 74/560 |
| 3,643,525 | 2/1972 | Gibas . | |
| 5,078,024 | 1/1992 | Cicotte et al. | 74/513 X |
| 5,233,882 | 8/1993 | Byram et al. . | |
| 5,408,899 | 4/1995 | Stewart . | |
| 5,460,061 | 10/1995 | Redding et al. | 74/513 X |
| 5,632,183 | 5/1997 | Rixon et al. | 74/560 X |
| 5,722,302 | 3/1998 | Rixon et al. | 74/512 |

FOREIGN PATENT DOCUMENTS

| | | | |
|---|---|---|---|
| 3427416 | 2/1986 | Germany | 74/512 |
| 813923 | 5/1959 | United Kingdom | 74/562 |

*Primary Examiner*—Charles A. Marmor
*Assistant Examiner*—Mary Ann Battista
*Attorney, Agent, or Firm*—Howard & Howard

[57] ABSTRACT

An adjustable control pedal assembly for a motor vehicle. The assembly includes an extensible module positioned on the lower end of the pedal arm of the pedal assembly and carrying the pedal pad. The module includes two screw jacks which may be selectively extended or contracted to vary the distance to the pedal pad from the lower end of the pedal arm and thereby accommodate drivers of various statures. The lower screw jack includes a coarser thread than the upper screw jack so that as the pedal pad is moved away from the lower end of the pedal arm in response to extension of the screw jacks the pedal pad is also pivoted upwardly to further accommodate drivers of small stature.

35 Claims, 3 Drawing Sheets

ADJUSTABLE PEDAL APPARATUS

BACKGROUND OF THE INVENTION

This invention relates to control pedal apparatuses and more particularly to adjustment means for selectively adjusting the position of one or more of the control pedals of a motor vehicle.

In a conventional automotive vehicle, pedals are provided for controlling brakes and engine throttle. If the vehicle has a manual transmission, a clutch pedal is also provided. These pedals are foot operated by the driver. In order for the driver to maintain the most advantageous position for working these control pedals, the vehicle front seat is usually slidably mounted on a seat track with means for securing the seat along the track in a plurality of adjustment positions.

The adjustment provided by moving the seat along the seat track does not accommodate all vehicle operators due to large differences in anatomical dimensions. Further, there is growing concern that the use of seat tracks, and especially long seat tracks, constitutes a safety hazard in that the seat may pull loose from the track during an accident with resultant injuries to the driver and/or passengers. Further, the use of seat tracks to adjust the seat position has the effect of positioning shorter operators extremely close to the steering wheel where they are susceptible in an accident to injury from the steering wheel or from an exploding air bag. It is therefore desirable to either eliminate the seat track entirely or shorten the seat track to an extent that it will be strong enough to retain the seat during an impact. Shortening or eliminating the seat track requires that means be provided to selectively adjust the various control pedals to accommodate various size drivers.

Various proposals have been made over a period of many years to provide selective adjustment of the pedal position to accommodate various size drivers but none of these proposals have met with any significant commercial acceptance since the proposed mechanisms have been unduly complex and expensive and/or have required large amounts of specialized design and testing for each individual vehicular application.

SUMMARY OF THE INVENTION

This invention is directed to the provision of a simple, inexpensive and effective apparatus for adjusting the control pedals of a motor vehicle.

More specifically, this invention is directed to the provision of an adjustable control pedal apparatus that is simple and inexpensive and that may be universally applied to virtually any vehicular application without the need for individual design or individual testing.

The adjustable control pedal apparatus of the invention is of the type including a pedal arm having a lower end, means mounting the pedal arm for movement relative to the vehicle, means operative in response to movement of the pedal arm relative to the vehicle to control an associated device of the vehicle, a pedal pad carried on the lower end of the pedal arm, and adjuster means operative to adjust the position of the pedal pad relative to an operator seated on a driver's seat of the vehicle. According to the invention, the adjuster means comprises means operative to adjust the position of the pedal pad relative to the pedal arm. This simple and direct arrangement provides a simple and effective means of adjusting the position of the pedal assembly relative to a wide variety of driver anatomies.

According to a further feature of the invention, the adjuster means are operative to adjust both the distance of the pedal pad from the lower end of the pedal arm and the angle of the pedal pad relative to the lower end of the pedal arm. This arrangement insures that the pedal pad undergoes a proper ergonomic tilting movement, in order to accommodate shorter drivers, as the pedal pad is moved away from the pedal arm.

According to a further feature of the invention, the adjuster means includes a module on the lower end of the pedal arm including an extensible device positioned between the pedal arm and the pedal pad and drive means operative to extend the extensible device and adjust the position of the pedal pad relative to the lower end of the pedal arm. This arrangement provides a simple and effective means of selectively extending the pedal pad relative to the pedal arm to suit drivers of various statures.

According to a further feature of the invention, the drive means includes a drive cable and transmission means operative in response to rotation of the cable to extend the extensible device. This arrangement allows known, reliable drive mechanisms to be employed to provide the required extensible movement of the pedal pad relative to the pedal arm.

According to a further feature of the invention, the extensible device comprises a screw jack including a rotatable base member and telescopic members positioned telescopically within the base member and extensible relative to the base member in response to rotation of the base member, and the transmission means is operative in response to rotation of the cable to rotate the base member of the screw jack. This arrangement allows the screw jack to extend in response to rotation of the cable to effect selective distancing of the pedal pad from the pedal arm.

According to a further feature of the invention, the screw jack comprises an upper screw jack; the adjuster means further includes a lower screw jack positioned on the lower end of the pedal arm below the upper screw jack and including a rotatable base member and telescopic members positioned telescopically within the base member and extendible relative to the base member in response to rotation of the base member; and the transmission means is operative in response to rotation of the cable to simultaneously rotate the base members of the upper and lower screw jack to thereby selectively extend the telescopic members of the upper and lower screw jacks. The use of upper and lower screw jacks provides a secure, stable movement of the pedal pad relative to the pedal arm.

According to a further feature of the invention, the lower screw jack employs a coarser drive thread than the upper screw jack so that the lower screw jack extends further in response to a given number of rotations of the base members whereby to tilt the pedal pad relative to the pedal arm as the pedal pad moves away from the pedal arm. This arrangement provides a simple and effective means of tilting the pedal pad upwardly toward shorter drivers as the pedal pad is moved away from the pedal arm.

DETAILED DESCRIPTION OF THE PREFERRED EMBODIMENT

Figure 5:
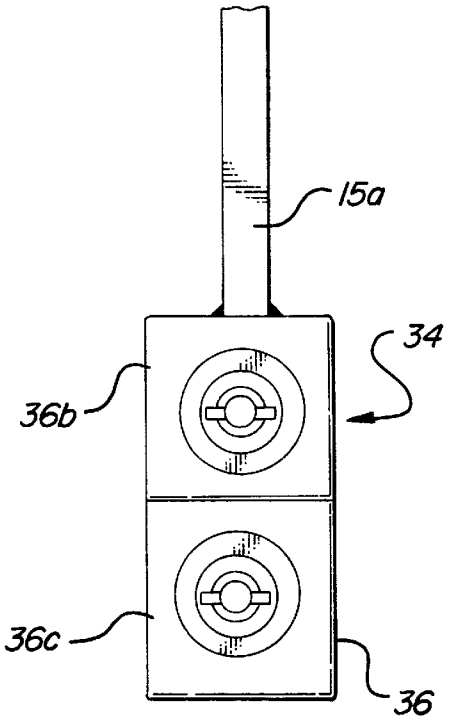
FIG. 5 is a detailed view of the lower end of the pedal arm of the adjustable pedal apparatus.

The adjustable pedal apparatus 10 of the invention is illustrated in the drawings in association with a motor vehicle including a floor pan 11, a dash panel or fire wall 12, an instrument panel 13, and an operator's seat 14.

Adjustable pedal apparatus 10, broadly considered, includes a pedal arm 15, a pedal pad 16, and an adjuster mechanism 18.

Pedal arm 15 is pivotally mounted to the vehicle at 20 via a bracket 22 secured to the fire wall of the vehicle at a location intermediate upper end 15*a* of the pedal arm and lower end 15*b* of the pedal arm. A Bowden cable 24 is secured to the upper end 15*a* of the pedal arm and extends to an accelerator assembly (not shown) of the vehicle so that the accelerator assembly is controlled in response to pivotal movement of the pedal arm about pivot point 20.

Pedal pad 16 comprises a slightly arcuate pad portion 16*a* for coaction with the foot 30 of an operator 32 positioned on seat 14 and a mounting portion 16*b* secured to the underface of pad portion 16*a*. Mounting portion 16*b* has a stepped configuration including an upper portion 16*c* and a lower portion 16*d*.

Adjuster mechanism 18 includes an extensible module 34 and drive means 35.

Module 34 includes a housing 36 secured to the lower end 15*b* of the pedal arm, an upper screw jack 38, and a lower screw jack 40. Housing 36 has a stepped rear face 36*a* having a configuration corresponding generally to the stepped configuration of pedal pad mounting portion 16*b*. Stepped rear face 36*a* defines an upper face portion 36*b* a lower face portion 36*c*. Rear face portion 36*c* is stepped rearwardly with respect to rear face portion 36*b* to an extent corresponding to the extent to which the upper and lower portions 16*b*/16*c* of the mounting portion of the pedal pad are stepped with respect to each other.

Housing 36 defines an upper cylindrical cavity 36*d* opening at 36*e* in rear face portion 36*b* and a lower cylindrical cavity 36*f* opening at 36*g* in rear face portion 36*c*. Lower cavity 36*f* is stepped rearwardly from upper cavity 36*d* by an amount commensurate with the rearward spacing of face portion 36*c* from face portion 36*b*.

Upper screw jack 38 comprises a plurality of cylindrical members which are telescopically arranged one within the other. Specifically, screw jack 38 includes a base member 42 of annular cylindrical configuration; a large screw member 44 of annular cylindrical configuration; an intermediate screw member 46 of annular cylindrical configuration; and a small or free end screw member 48 of solid cylindrical configuration.

Base member 42 is mounted for rotation in cavity 36*d* and includes a gear portion 42*a* having an inner diameter defining an annular threaded portion 42*b*; large screw member 44 is sized to pass through opening 36*e* and includes an exterior thread 44*a* coacting with thread 42*b*, a forward outer flange portion 44*b* having an exterior diameter corresponding generally to the interior diameter of base member 42, and a rear inwardly extending flange portion 44*c* defining a screw thread 44*d*.

Intermediate screw member 46 has an exterior thread 46*a* for coaction with screw thread 44*d*, a forward outer flange portion 46*b* having an exterior diameter corresponding generally to the interior diameter of screw member 44 and a rear inwardly extending flange portion 46*c* defining a screw thread 46*d*.

Screw 48 defines an external thread 48*a* for coaction with screw thread 46*d*, a front flange 48*b* having an external diameter corresponding generally to the internal diameter of screw member 46, and a rearward pin portion 48*c*. Pin portion 48*c* is pivotally connected to upper pedal pad mounting portion 16*c* by a pivot pin 49.

Lower screw jack 40 is generally similar to upper screw jack 38. Specifically, lower screw jack 40 includes a base member 50, a large screw member 52, an intermediate screw member 54, and a small or free end screw member 56.

Base member 50 is mounted for rotation in cavity 36*f* and includes a forward gear portion 50*a* for meshing coaction with gear portion 42*a* of base member 42 via a passage 36*h* in the housing and a rear flange portion 50*b* defining a screw thread 50*c*.

Large screw member 52 is sized to pass through opening 36*g* and includes an external thread 52*a* for threaded coaction with screw thread 50*c*, a forward outer flange 52*b* having an external diameter corresponding generally to the internal diameter of base member 50, and a rear inward flange 52*c* defining a screw thread 52*d*.

Intermediate screw member 54 has an external thread 54*a* for coaction with screw thread 52*d*, a forward outer flange 54*b* having an external diameter corresponding generally to the internal diameter of screw member 52, and a rear inward flange 54*c* defining a screw thread 54*d*.

Small or free end screw member 56 has an external thread 56*a* for coaction with screw thread 54*d*, a forward flange 56*b* having an external diameter corresponding generally to the internal diameter of screw member 54, and a rearward pin portion 56*c*. Pin portion 56*c* is pivotally connected to lower pivot pad mounting portion 16*d* by a pivot pin 57.

Drive means 35 includes an electric motor 58 secured, for example, to fire wall 12; a Bowden cable 60 driven by the motor and passing downwardly through a bore 36*i* in the extensible module housing; a transmission 62 driven by the cable, and an output shaft 64 driven by the transmission and centrally connected to the forward wall 42*c* of the base member 42 of upper screw jack 38. Transmission 62 comprises a worm 66 secured to the free lower end of cable 60 driving a worm gear 68 fixedly and centrally secured to output shaft 64.

Motor 58 is controlled via a circuit 70 associated with the vehicle battery 72 and includes, for example, a toggle switch 74 mounted in instrument panel 13 and operative in response to toggling movement by the vehicle operator to energize motor 58 in forward and rearward directions.

Operation

In operation, and in known manner, as the operator's foot 30 is applied to the pedal pad 16, pedal arm 15 is pivoted about pivot pin 20 to move Bowden cable 24 and selectively control the accelerator assembly of the vehicle. For example, the idle position of the pedal assembly is seen in solid lines in FIG. 2 and the maximum acceleration position is seen in dash lines in FIG. 2. It will be seen that the angled cut-away portion 36*j* of the front face of the extensible module housing provides clearance with the lower angled portion 12*a* of the vehicle fire wall to facilitate the desired amount of pivotal movement of the pedal assembly between idle and maximum acceleration positions.

Figure 1:
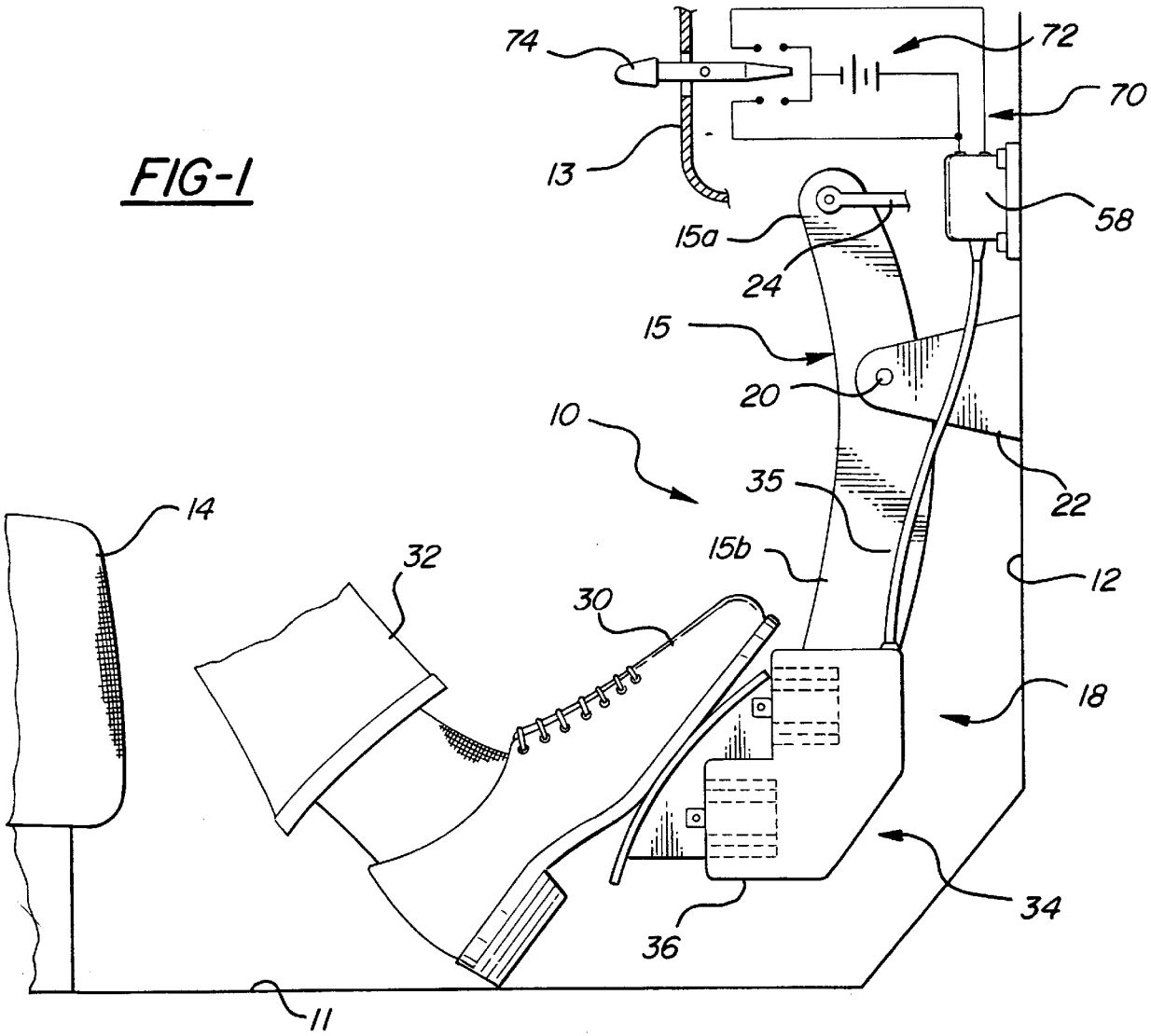
FIG. 1 is a side elevational view of the adjustable pedal apparatus of the invention with the apparatus shown in a contracted condition to accommodate taller drivers.
Figure 2:
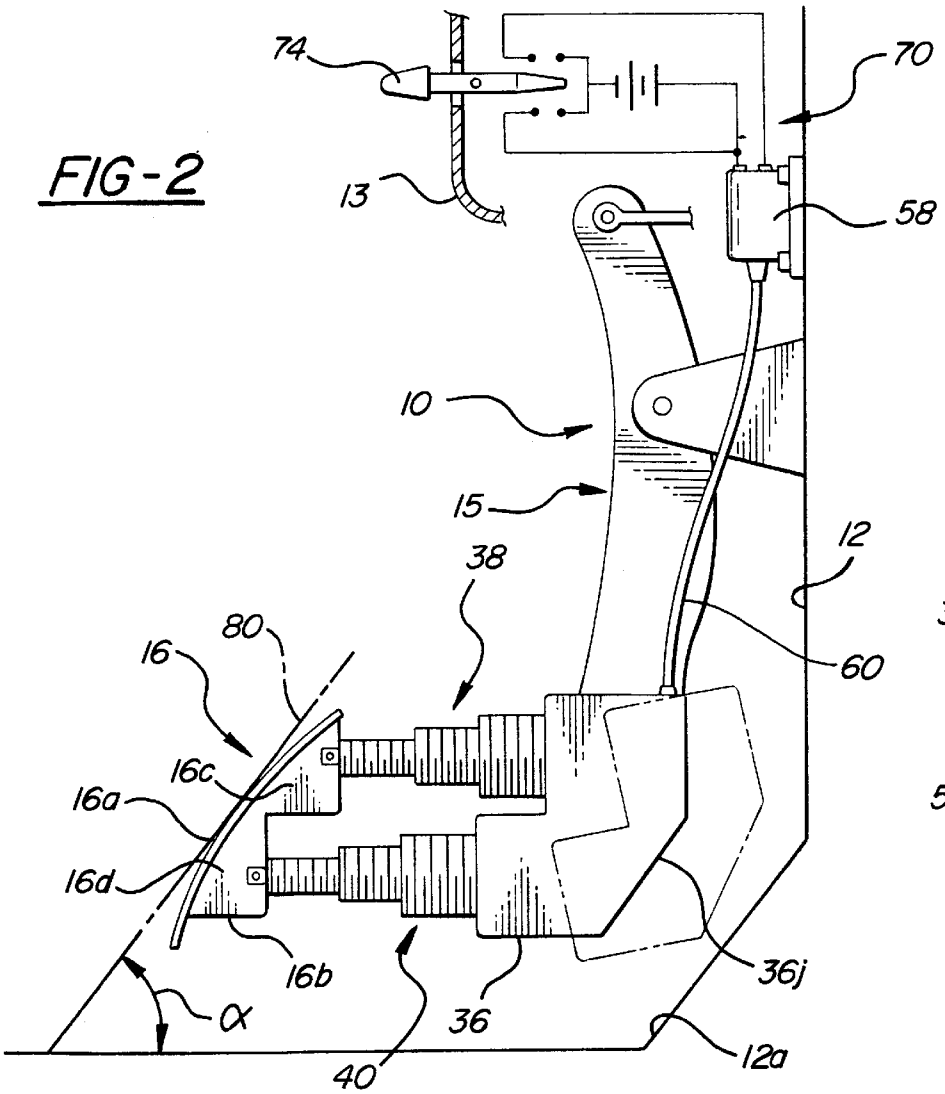
FIG. 2 is a side elevational view of the adjustable pedal apparatus shown in extended condition to accommodate shorter drivers.
Figure 3:
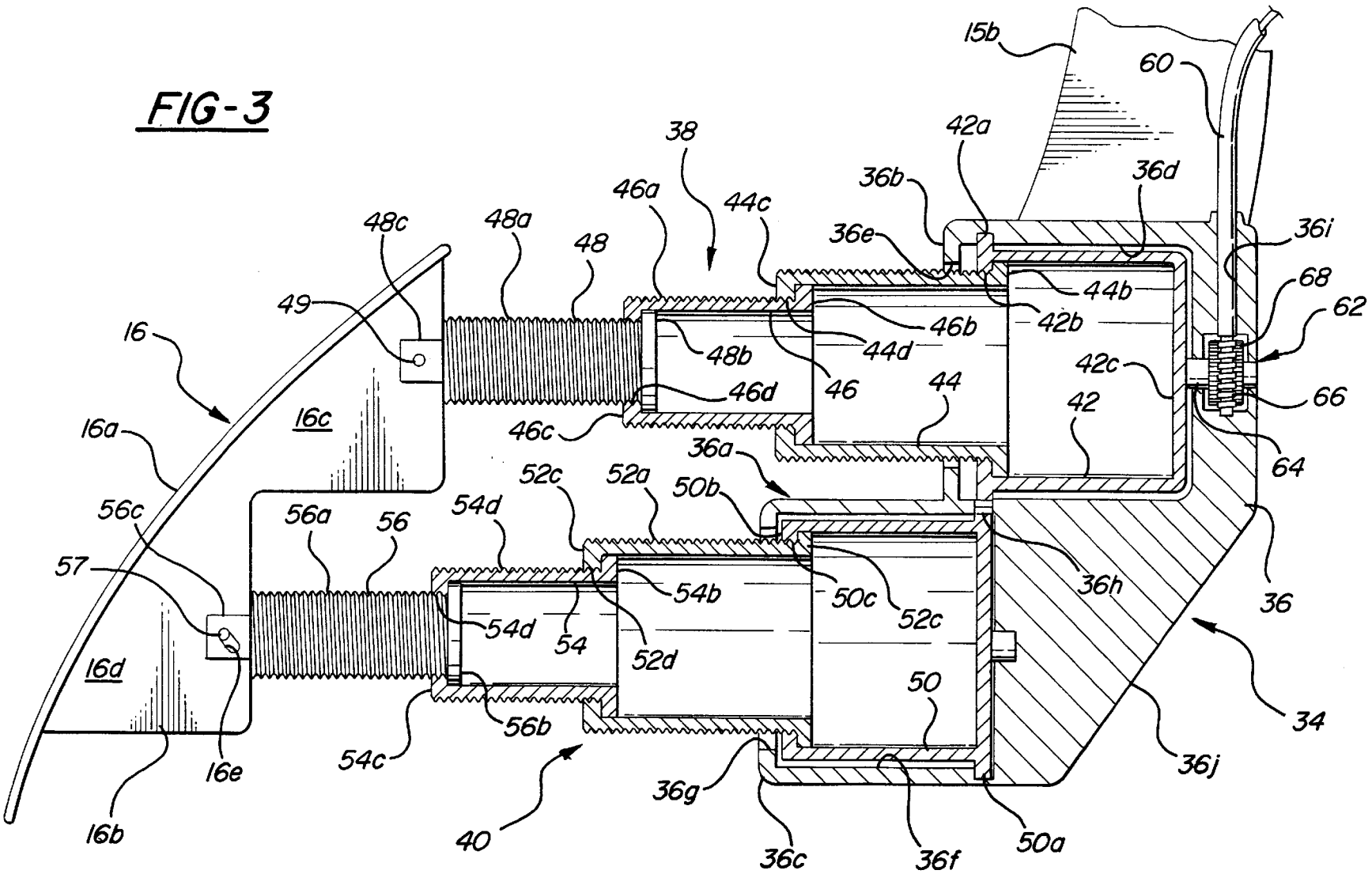
FIG. 3 is a cross-sectional view showing details of an extensible module utilized to adjust the pedal assembly.

The pedal apparatus is seen in FIG. 1 in its totally retracted position to accommodate drivers of relatively large stature and is seen in FIG. 2 in its maximum extended position to accommodate drivers of relatively short stature. The selected or desired position of extension of the pedal assembly is chosen by the operator and specifically is determined by operator actuation of switch 74 to selectively energize motor 58.

Figure 4:
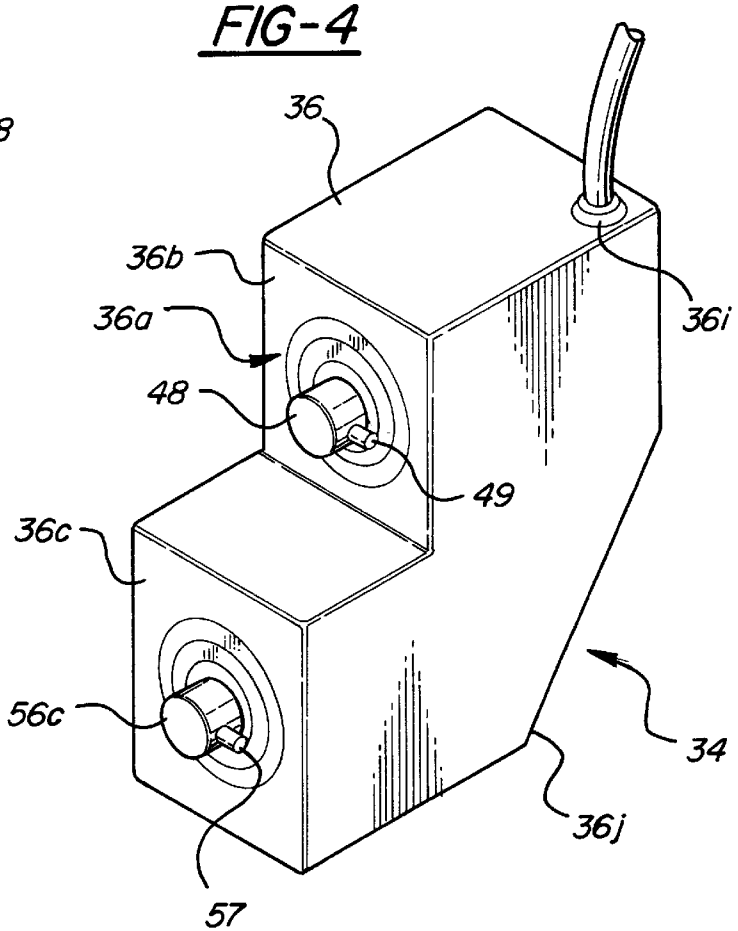
FIG. 4 is a perspective view of the extensible module.

Specifically, to move the pedal assembly between the extended position of FIG. 2 and the retracted position of FIG. 1, switch 74 is actuated to energize motor 58 to drive cable 60 and transmission 62 to rotate the base member 42 of the upper jack 38 and, via gears 42*a* and 50*a*, the base member 50 of lower screw jack 40. Base members 42 and 50 thus rotate in counter rotating directions, and large screw members 44/52 move forwardly within base members 42/50 via the threaded coaction of screws 42*b*/44*a* and 50*c*/52*a* until outer flange portion 44*b*/52*b* encounters the front wall of the respective base member whereafter the sections 44/52 rotate with the base members 42/50. Continued rotation of base members 42/50 resulting from continued energization of motor 58 now has the effect of moving intermediate screw members 46/54 forwardly within large screw members 46/52 by virtue of the coaction between threads 46*d*/48*a* and 52*d*/54*a*. Intermediate screw members 46/52 move telescopically forwardly within large screw members 44/52 until forward flange portions 46*b*/54*b* encounter the forward wall of the respective base member whereupon members 46/54 begin to rotate with the base members so that, upon continued energization of motor 58, screw members 48/56 begin to move telescopically forwardly within screw members 46/54 by virtue of the threaded coaction between threads 46*d*/48*a* and 54*d*/56*a*. The forward telescoping movement of the small screw members 48/58 within intermediate members 46/54 will again continue until the forward flange 48*b*/56*b* of the small screw members encounters the forward wall of the respective base member at which point maximum contraction will have been achieved. This position of maximum contraction is best seen in FIGS. 1 and 4. Note that as the extensible module achieves the maximum retracted position, the stepped configuration of the mounting portion 16*b* of the pedal pad 16 moves into complementary meshing engagement with the stepped configuration of the rear face 36*a* of the extensible modular housing to provide a compact and stable configuration.

Movement of the pedal assembly from the contracted condition of FIG. 1 to the extended position of FIG. 2 to accommodate drivers of shorter stature is accomplished in a reverse manner in response to selective actuation of switch 74. Specifically, initial rotation of base members 42/50 results in rearward threaded movement of large screw members 44/52 out of telescopic relation with respect to the base members until flange portion 44*b* encounters the threaded portion 42*b* of the upper base member and flange portion 52*b* encounters inner flange 50*b* whereafter continued rotation of the base members results in rearward movement of intermediate screw members 26/54 rearwardly out of telescopic relation with large members 44/52 until flanges 46*b*/54*b* bottom against flanges 44*c*/52*c* whereafter continued rotational movement of base members 42/50 results in rearward movement of screw members 48/56 out of telescopic relation with intermediate screw members 46/54 until flange members 48*b*/56*b* encounter flange portions 46*c*/54*c* which determines the maximum extension of the extensible module and thereby the maximum adjustment to accommodate drivers of short stature.

It is desirable in some applications to adjust the angle of the pedal pad as the pedal pad is moved rearwardly to accommodate drivers of shorter stature so that the angle $\alpha$ between the plane 80 of the pedal pad and the floor pan 12 is decreased as the pedal pad moves rearwardly to accommodate shorter drivers. That is, it is sometimes desirable to rotate the pedal pad upwardly as the pad is moved rearwardly.

This is accomplished according to the present invention by providing coarser screw threads on the lower screw jack 40 than on the upper screw jack 38 so that the lower screw jack undergoes a larger amount of linear movement, either in a contracting or extending direction, in response to a given number of rotations of the base members. That is, threads 50*c*, 52*a*, 52*d*, 54*a*, 54*d*, and 56*a* are coarser than threads 42*b*, 44*a*, 44*d*, 46*a*, 46*b*, and 48*a* so that, as the pedal pad is moved rearwardly by the extending screw jacks, the pedal pad not only moves further away from the lower end of the pedal arm to accommodate drivers of shorter stature but also pivots or tilts upwardly to further accommodate the drivers of shorter stature.

It will be understood, in this regard, that the linear length of the various screw elements of the lower jack 40 are made commensurately larger than the linear lengths of the corresponding screw members of the upper jack 38 to allow the further linear extension of the lower screw jack as compared to the upper screw jack. Further, the pin 57 carried on the free end of the pin portion 56*c* of the lower screw jack is received in an arcuate slot 16*e* in the lower portion 16*b* of the mounting portion of the pedal pad to allow the upward pivotal movement of the pedal pad as the pedal pad is moved rearwardly to accommodate shorter drivers.

Although the amount of adjustable movement provided will of course vary depending upon the particular application, it has been found that the design of the present invention can readily provide an amount of adjusting movement sufficient to satisfy most vehicular applications. One prototype unit built in accordance with the invention, for example, provides 76 mm of adjusting movement which is sufficient to satisfy the requirements of almost all vehicular applications.

The adjustable pedal assembly of the invention will be seen to provide many important advantages. Specifically, the modular concept allows one size of extensible module to be utilized in virtually all vehicular applications irrespective of extreme variations in dimensional and packaging requirements of the various vehicle applications. This in turn allows an extensible module according to the invention to be designed and tested and thereafter provided to the industry, without further design or testing, in satisfaction of virtually all vehicular applications. The resulting economies of scale significantly reduce the cost of the total package.

The invention design also provides an extremely compact overall pedal assembly package allowing the invention pedal assembly to be utilized in even the most crowded of the under-instrument panel environments encountered in present day vehicles.

Whereas a preferred embodiment of the invention has been illustrated and described in detail, it will be apparent that various changes may be made in the disclosed embodiment without departing from the scope or spirit of the invention.

What is claimed is:

1. An adjustable pedal assembly for a motor vehicle comprising:

a pedal arm having a free end;

means mounting the pedal arm for movement relative to the vehicle;

means operative in response to movement of the pedal arm relative to the vehicle to control an associated device of the vehicle;

a pedal pad carried on the free end of the pedal arm; and adjuster means with a screw jack assembly interconnecting the free end of the pedal arm and the pedal pad for selectively adjusting the position of the pedal pad relative to the free end of the pedal arm.

2. An adjustable pedal assembly according to claim 1 wherein the adjuster means are operative to adjust both the distance of the pedal pad from the free end of the pedal arm and the angle of the pedal pad relative to the free end of the pedal arm.

3. An adjustable pedal assembly according to claim 2 wherein the screw jack assembly comprises:

upper and lower extensible devices carried on the free end of the pedal arm and engaging upper and lower regions on the pedal pad; and drive means operative to extend the extensible devices by differential amounts whereby to tilt the pedal pad in response to extension of the extensible devices.

4. An adjustable pedal assembly according to claim 3 wherein:

the upper extensible device comprises an upper screw jack including a rotary drive member and the lower extensible device comprises a lower screw jack including a rotary drive member;

the drive means are operative to rotate the drive members of the upper and lower screw jacks at the same speed; and the lower screw jack employs a coarser thread than the upper screw jack so that, for a given number of revolutions of the drive members, the lower jack extends further than the upper screw jack whereby to tilt the pedal pad upwardly as the pad moves away from the free end of the pedal arm.

5. An adjustable pedal assembly according to claim 1 wherein:

the pedal arm is pivotally mounted on a vehicle structure at a pivot point and the free end of the pedal arm comprises a lower end of the pedal arm;

the adjuster means includes an extensible device interconnecting the lower end of the pedal arm and the pedal pad, the extensible device including the screw jack assembly, and drive means operative to extend the extensible device and adjust the position of the pedal pad relative to the lower end of the pedal arm.

6. An adjustable pedal assembly according to claim 5 wherein the drive means includes a drive cable and transmission means operative in response to rotation of the cable to extend the extensible device.

7. An adjustable pedal assembly according to claim 6 wherein:

the screw jack assembly includes a rotatable base member and telescopic members positioned telescopically within the base member and extensible relative to the base member in response to rotation of the base member; and the transmission means is operative in response to rotation of the cable to rotate the base member of the screw jack to thereby extend the telescopic members.

8. An adjustable pedal assembly according to claim 7 wherein:

the screw jack assembly comprises an upper screw jack;

the adjuster means further includes a lower screw jack positioned on the lower end of the pedal arm below the upper screw jack and including a rotatable base member and telescopic members positioned telescopically within the base member and extensible relative to the base member in response to rotation of the base member; and the transmission means is operative in response to rotation of the cable to simultaneously rotate the base members of the upper and lower screw jacks to thereby extend the telescopic members of the upper and lower screw jacks.

9. An adjustable pedal assembly according to claim 8 wherein the lower screw jack employs a coarser drive thread than the upper screw jack so that the lower screw jack extends further in response to a given number of rotations of the base members whereby to tilt the pedal pad relative to the pedal arm as the pedal pad moves away from the pedal arm.

10. An adjustable vehicle pedal assembly including a pedal arm having a lower end, means mounting the pedal arm for pivotal movement relative to a vehicle, means operative in response to pivotal movement of the pedal arm relative to the vehicle to control an associated device of the vehicle, a pedal pad carried on the lower end of the pedal arm, and adjuster means operative to adjust the position of the pedal assembly relative to an operator seated on a driver's seat of the vehicle, characterized in that:

the adjuster means comprises an extensible device having a screw assembly operative to adjust the position of the pedal pad relative to the pedal arm.

11. An adjustable pedal assembly according to claim 10 wherein the extensible device interconnects the lower end of the pedal arm and the pedal pad, and the adjuster means includes drive means operative to extend the extensible device and adjust the position of the pedal pad relative to the lower end of the pedal arm.

12. An adjustable pedal assembly according to claim 11 wherein the drive means includes a drive cable and transmission means operative in response to rotation of the cable to extend the extensible device.

13. An adjustable pedal assembly according to claim 12 wherein:

the screw assembly includes a rotatable base member and telescopic members positioned telescopically within the base member and extensible relative to the base member in response to rotation of the base member; and the transmission means is operative in response to rotation of the cable to rotate the base member of the screw jack to thereby extend the telescopic members.

14. An adjustable pedal assembly according to claim 13 wherein:

the screw assembly comprises an upper screw jack and a lower screw jack positioned on the lower end of the pedal arm below the upper screw jack and including a rotatable base member and telescopic members positioned telescopically within the base member and extensible relative to the base member in response to rotation of the base member; and the transmission means is operative in response to rotation of the cable to simultaneously rotate the base members of the upper and lower screw jacks to thereby extend the telescopic members of the upper and lower screw jacks.

15. An adjustable pedal assembly according to claim 14 wherein the lower screw jack employs a coarser drive thread than the upper screw jack so that the lower screw jack extends further in response to a given number of rotations of the base members whereby to tilt the pedal pad relative to the pedal arm as the pedal pad moves away from the pedal arm.

16. An adjustable pedal assembly for a motor vehicle comprising:

a pedal arm including a free lower end and means for pivotally mounting the arm on the vehicle;

a pedal pad located at a distance from the pedal arm and being orientated at an angle relative to the lower end of the pedal arm;

an extensible module interconnecting the pedal pad and the lower end of the pedal arm and having an adjustment assembly for adjusting the distance of the pedal pad from the lower end of the pedal arm and for adjusting the angle of the pedal pad relative to the lower end of the pedal arm; and drive means operative to extend the extensible module and adjust the distance of the pedal pad from the lower end of the pedal arm while simultaneously adjusting the angle of the pedal pad relative to the lower end of the pedal arm.

17. An adjustable pedal assembly according to claim 16 wherein:

the extensible module comprises a housing fixedly secured to the lower end of the pedal arm and an extension device mounted on the housing and having a free extendible end; and the pedal pad is mounted on the extendible end of the extension device.

18. An adjustable pedal assembly according to claim 17 wherein the extension device comprises a screw jack.

19. An adjustable pedal assembly according to claim 19 wherein:

the screw jack is an upper screw jack having a free end; and the extension device further includes a lower screw jack positioned on the housing below the upper screw jack and having a free end connected to the pedal pad below a connection of the free end of the upper screw jack to the pedal pad.

20. An adjustable pedal apparatus for a vehicle comprising:

a mounting structure adapted to be mounted on the vehicle;

a pedal arm attached to said mounting structure for movement relative thereto, said pedal arm having a distal end;

a pedal pad supported by said distal end of said pedal arm and having a pad surface spaced apart from said distal end of said pedal arm by a defined distance;

an adjustment assembly supported by said distal end of said pedal arm for engaging said pedal pad; and a drive assembly for driving said adjustment assembly;

said apparatus characterized by said adjustment assembly selectively and infinitely adjusting said distance of said pedal pad surface relative to said distal end of said pedal arm.

21. An apparatus as set forth in claim 20 wherein said pedal pad defines a pedal plane orientated at a defined pedal angle between said pedal plane and a vehicle floor, said adjustment assembly selectively and infinitely adjusting the pedal angle by rotating the pedal pad with respect to said distal end of said pedal arm.

22. An apparatus as set forth in claim 21 wherein said adjustment assembly simultaneously adjusts the pedal angle by rotating the pedal pad with respect to said distal end of said pedal arm while adjusting said distance of said pedal pad surface relative to said distal end of said pedal arm.

23. An apparatus as set forth in claim 20 wherein said adjustment assembly includes a screw shaft moveable between a extended position and a retracted position, said screw shaft attached to said pedal pad for adjusting said distance of said pad surface with respect to said distal end of said pedal arm.

24. An apparatus as set forth in claim 23 wherein said screw shaft is comprised of a plurality of shaft portions in telescoping relationship to one another.

25. An apparatus as set forth in claim 24 wherein said plurality of shaft portions is comprised of at least a first shaft portion and a second shaft portion, said second shaft portion being threadably engaged to said first shaft portion for movement relative thereto.

26. An apparatus as set forth in claim 25 wherein said adjustment assembly includes a base member having a threaded portion and interconnecting said driving assembly and said first shaft portion, said driving assembly providing rotational input to said base member, said base member providing rotational input for said first shaft portion via said threaded portion such that said first shaft portion rotates and extends linearly from said base member, and said first shaft portion provides rotational input for said second shaft portion such that said second shaft portion rotates and extends linearly from said first shaft portion.

27. An apparatus as set forth in claim 23 wherein said screw shaft is an upper screw shaft and said adjustment assembly includes a lower screw shaft spaced apart from and parallel to said upper screw shaft, said upper and lower screw shafts moving between said retracted and extended positions for adjusting said distance of said pad surface with respect to said distal end of said pedal arm.

28. An apparatus as set forth in claim 27 wherein in said upper and lower screw shafts receive rotational input from said driving assembly resulting in linear movement of said upper and lower screw shafts with respect to said pedal pad.

29. An apparatus as set forth in claim 28 wherein said upper screw shaft has a threaded portion with a first lead and said lower screw shaft has a threaded portion with a second lead, said second lead being different than said first lead such that said upper screw shaft moves a first linear distance and said lower screw shaft moves a second linear distance, different than said first linear distance, when said drive assembly rotates said upper and lower screw shafts at the same speed.

30. An apparatus as set forth in claim 29 wherein said pedal pad defines a pedal plane orientated at a defined pedal angle between said pedal plane and a vehicle floor, said upper and lower screw shafts causing said pedal angle to vary as said upper screw shaft moves said first linear distance and said lower screw shaft moves said second linear distance.

31. An apparatus as set forth in claim 27 wherein said upper and lower screw shafts are each comprised of a plurality of shaft portions in telescoping relationship to one another.

32. An apparatus as set forth in claim 27 including a housing for supporting said upper and lower screw shafts, said housing being attached to said distal end of said pedal arm.

33. An apparatus as set forth in claim 32 wherein said upper screw shaft is extendible from said housing to a first maximum distance with respect to said distal end of said pedal arm and said lower screw shaft is extendible from said housing to a second maximum distance with respect to said distal end of said pedal arm, said second maximum distance being different than said first maximum distance.

34. An apparatus as set forth in claim 20 including a control mechanism for remotely controlling said adjustment assembly.

35. An apparatus as set forth in claim 34 wherein said control mechanism is a switch assembly for actuating said drive assembly, said drive assembly having a control cable for driving said adjustment assembly.

* * * * *